US007608374B2

(12) United States Patent
Tomita

(10) Patent No.: US 7,608,374 B2
(45) Date of Patent: Oct. 27, 2009

(54) TONER AND DEVELOPER USING THE TONER

(75) Inventor: Masami Tomita, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 461 days.

(21) Appl. No.: 11/622,477

(22) Filed: Jan. 12, 2007

(65) Prior Publication Data

US 2007/0160924 A1 Jul. 12, 2007

(30) Foreign Application Priority Data

Jan. 12, 2006 (JP) ..... 2006-004712

(51) Int. Cl.
*G03G 9/00* (2006.01)

(52) U.S. Cl. ..... 430/108.8; 430/108.4; 430/110.4; 430/111.4; 399/252

(58) Field of Classification Search ..... 430/108.4, 430/108.8, 111.4, 110.4; 399/252
See application file for complete search history.

(56) References Cited

U.S. PATENT DOCUMENTS

| | | | |
|---|---|---|---|
| 6,363,229 | B1 | 3/2002 | Shiraishi et al. |
| 6,740,460 | B2 | 5/2004 | Tomita et al. |
| 6,756,175 | B2 | 6/2004 | Emoto et al. |
| 6,824,945 | B2 | 11/2004 | Emoto et al. |
| 7,056,636 | B2 | 6/2006 | Tomita et al. |
| 2001/0044059 | A1 | 11/2001 | Miyamoto et al. |
| 2002/0098436 | A1 | 7/2002 | Miyamoto et al. |
| 2003/0027066 | A1 | 2/2003 | Yamashita et al. |
| 2003/0055159 | A1 | 3/2003 | Yamashita et al. |
| 2003/0096185 | A1 | 5/2003 | Yamashita et al. |
| 2004/0076901 | A1 | 4/2004 | Miyamoto et al. |
| 2006/0093946 | A1 | 5/2006 | Miyamoto et al. |

FOREIGN PATENT DOCUMENTS

| | | |
|---|---|---|
| JP | 60-230663 | 11/1985 |
| JP | 01-234858 | 9/1989 |
| JP | 03-168649 | 7/1991 |
| JP | 04-255865 | 9/1992 |
| JP | 08-101526 | 4/1996 |
| JP | 09-230621 | 9/1997 |
| JP | 11-190914 | 7/1999 |
| JP | 2002-139864 | 5/2002 |
| JP | 2003-091099 | 3/2003 |
| JP | 2004-309873 | 11/2004 |
| JP | 2005-215148 | 8/2005 |

OTHER PUBLICATIONS

U.S. Appl. No. 09/384,797, filed Aug. 27, 1999.
U.S. Appl. No. 11/734,895, filed Apr. 13, 2007, Yamashita et al.

*Primary Examiner*—Mark A Chapman
(74) *Attorney, Agent, or Firm*—Oblon, Spivak, McClelland, Maier & Neustadt, L.L.P.

(57) ABSTRACT

A toner including a binder resin, and a release agent, wherein the following relationships are satisfied:

$$2\ \mu m \leqq D4 \leqq 4\ \mu m \quad (a)$$

$$0.05\ \mu m \leqq Dw \leqq 0.3\ \mu m \quad (b)$$

$$Dw \leqq 0.075 \times D4 \quad (c)$$

$$F \leqq -40 \times Dw + 19 \quad (d)$$

$$F \leqq 20 \times Dw + 5 \quad (e)$$

wherein D4 is a weight-average particle diameter of the toner, Dw is an average dispersion diameter of the release agent and F is a pulverizability index of the toner.

13 Claims, 1 Drawing Sheet

TONER AND DEVELOPER USING THE TONER

BACKGROUND OF THE INVENTION

1. Field of the Invention

The present invention relates to a toner and a developer using the toner, and more particularly to a toner and a developer using the toner for use in electrostatic copying processes in image forming apparatuses such as copiers, facsimiles and printers.

2. Discussion of the Background

A developer used in electrophotography, electrostatic recoding or electrostatic printing is attached to an image bearer such as a photoreceptor an electrostatic latent image is formed on in the developing process, transferred to a transfer medium such as a transfer paper from the image bearer in the transfer process and fixed on the transfer paper in the fixing process.

A magnetic brush method, a cascade developing method or a powder cloud method is known as a method of visualizing an electrostatic latent image with a toner.

Typically, after an electrostatic latent image is developed on a photoreceptor with a toner to form a visible toner image thereon, the toner image is transferred onto a transfer sheet and fixed thereon. A toner image is typically fixed thereon by a heat-roll fixing method pressing the toner image upon application of heat onto a transfer sheet. Although the heat-roll fixing method is capable of quickly fixing a toner image because of its high heat efficiency, so-called an offset problem that a part of a toner image adheres to the surface of the roll, remains thereon and transfers again onto a transfer sheet tends to occur.

Conventionally, the surface of a fixing roller is formed of a material having good releasability from a toner, such as a silicone rubber and a fluorine-containing resin, to prevent the offset problem, and further a liquid having high releasability, such as a silicone oil and a fluorine-containing oil, is applied to the surface thereof, to prevent the offset problem and the fatigue of the surface thereof.

Although this prevents the offset problem very effectively, an applicator applying a liquid preventing offset problem is needed in a fixer, resulting in a problem that the fixer has a complicated configuration. In addition, the oil application causes peeling of layers forming the surface of a fixing roller, resulting in a shorter life thereof.

Published Unexamined Japanese Patent Applications Nos. 60-230663 and 1-234858 disclose a method of adding a release agent such as low-molecular-weight polyethylene and low-molecular-weight polypropylene in a toner in consideration of applying a liquid preventing offset problem from the toner when fixed upon application of heat and pressure instead of using the oil applicator.

A toner is conventionally prepared by uniformly mixing toner constituents such as a binder resin and a colorant in the shape of a powder, fusing and kneading the toner constituents, cooling the kneaded toner constituents to be hardened, pulverizing the hardened toner constituents, and classifying the pulverized toner constituents.

Recently, the toner is more required to have a smaller particle diameter in terms of producing higher quality images.

When an airflow pulverizer pulverizes a toner to have a smaller particle diameter, the resultant toner has a larger specific surface area and lower fluidity.

In addition, a toner is prepared by a polymerization method as well besides the above-mentioned method.

A toner prepared by the polymerization method has a smaller particle diameter and easily produces high definition images. In addition, the toner is spherical, and has a small specific surface area and constant fluidity. Further, the toner has good transferability to a receiving material.

However, the polymerization method has high production cost because of incapable of recycling an off-specification toner such as a fine powder produced during the process of preparing the toner. In addition, almost all the toners are spherical and easily scrape through cleaning members such as a cleaning blade in the process of cleaning a photoreceptor, resulting in poor cleaning.

Therefore, the above-mentioned fusing, kneading and pulverizing method is still used as a mainstream method as the polymerization method is.

Published Unexamined Japanese Patent Application No. 2005-215148 discloses a toner and a method of preparing the toner as a method of downsizing the particle diameter thereof, which is prepared by the fusing, kneading and pulverizing method, wherein the toner includes at least a binder resin and a colorant, prepared by the fusing, kneading and pulverizing method, has a volume-average particle diameter of from 5.0 to 8.5 μm, and has a circularity of form 0.955 to 0.980.

Namely, Published Unexamined Japanese Patent Application No. 2005-215148 discloses a method of preparing a toner having a small particle diameter, a high circularity, good transferability and producing quality images, which is prepared by a method including at least a process of pulverizing with an impact pulverizer.

However, when a toner prepared by the method disclosed in Published Unexamined Japanese Patent Application No. 2005-215148 includes a release agent, the probability of being exposed thereof on the surface of the toner increases.

When the release agent exposed on the surface of the toner increases, it leaves therefrom and adheres to a carrier when the toner is used therewith as a two-component developer and other charging members, resulting in deterioration of the chargeability and durability of the developer. Further, the release agent is also known to deteriorate the fluidity and transferability of a toner to a paper.

Therefore, when a toner has a smaller particle diameter, a wax therein preferably has a smaller dispersion diameter as well.

Published Unexamined Japanese Patent Application No. 3-168649 specifies that a low-molecular-weight wax in a binder resin has a dispersion diameter not greater than 1 μm. An object thereof is to prevent the offset problem, and a method of kneading toner constituents for a long time with a large shearing force is disclosed therein such that the wax has a desired dispersion diameter.

However, Published Unexamined Japanese Patent Application No. 3-168649 has low productivity because the production equipment having a large shearing force is limited and the toner constituents are kneaded for a long time.

Published Unexamined Japanese Patent Application No. 11-190914 discloses a toner for full-color electrophotography, wherein a colorant has a dispersion diameter not greater than 1 μm and release agent has a dispersion diameter of form 0.1 to 2 μm in a binder resin, and the following relationship is satisfied:

$$Q_{20}/Q_{600}\times 100=70\% \text{ or more (Z \%: charge buildability)}$$

wherein $Q_{600}$ is a charge quantity of the resultant developer when the toner is mixed with a carrier at a concentration of 5% while stirred for 10 min at normal temperature and humidity;

and $Q_{20}$ is a charge quantity of the resultant developer when the toner is mixed with a carrier at a concentration of 5% while stirred for 20 sec at normal temperature and humidity.

Namely, Published Unexamined Japanese Patent Application No. 11-190914 discloses a masterbatch wherein a release agent as well aw a colorant are more uniformly dispersed in a binder resin.

However, Published Unexamined Japanese Patent Applications Nos. 3-168649 and 11-190914 do not downsize both of the average particle diameter of a toner and the average dispersion diameter of a release agent. When a release agent is not uniformly dispersed in a toner, the release agent exposed on the surface thereof increases, resulting in deterioration of fluidity and durability of the toner.

Because of these reasons, a need exists for a toner having good fluidity and durability as well as a small particle diameter.

SUMMARY OF THE INVENTION

Accordingly, an object of the present invention is to provide a toner having good fluidity and durability as well as a small particle diameter.

This object and other objects of the present invention, either individually or collectively, have been satisfied by the discovery of a toner, comprising:

a binder resin, and a release agent, wherein the following relationships are satisfied:

$$2\ \mu m \leqq D4 \leqq 4\ \mu m \quad (a)$$

$$0.05\ \mu m \leqq Dw \leqq 0.3\ \mu m \quad (b)$$

$$Dw \leqq 0.075 \times D4 \quad (c)$$

wherein D4 is a weight-average particle diameter of the toner and Dw is an average dispersion diameter of the release agent, and wherein the following relationships (1) and (2) are satisfied:

$$F \leqq -40 \times Dw + 19 \quad (1)$$

$$F \leqq 20 \times Dw + 5 \quad (2)$$

wherein F is a pulverizability index of the toner.

Further, release agent preferably has a viscosity Gw of from 3 to 10 $mm^2/s$ at 100° C., the following relationship (3) is preferably satisfied:

$$(Gr/1{,}000) - 5 \leqq Gw \leqq (Gr/1{,}000) + 2 \quad (3)$$

wherein Gr is a viscosity (Pa·s) of the binder resin at 130° C.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
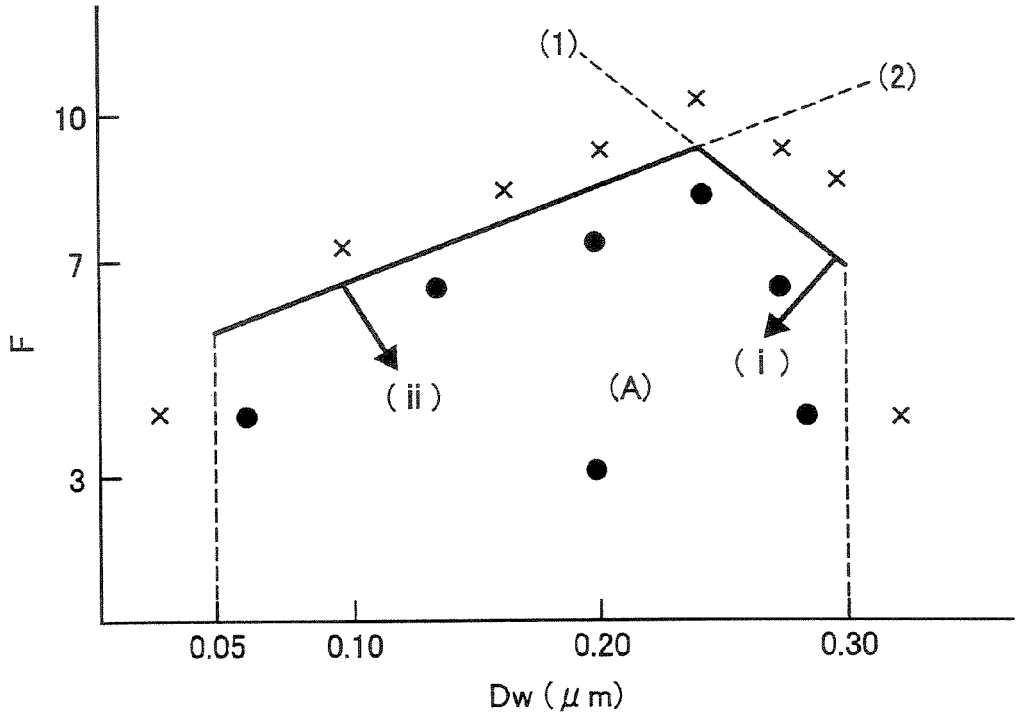
FIG. 1 is a diagram showing a relationship between the pulverizability index F of the toner and the average dispersion diameter Dw of the release agent of the present invention.

The present invention provides a toner and a developer having good fluidity and durability as well as a small particle diameter.

The toner of the present invention is prepared by fusing, kneading and pulverizing toner constituents including at least a binder resin and a release agent.

Conventionally, since the average dispersion diameter of a release agent has not sufficiently be refined, the release agent exposed on the surface of a toner increases as the toner has smaller average particle diameter, resulting in deterioration of fluidity of the toner. Further, the release agent leaving from the toner adheres to a carrier and an image bearer.

The present inventor discovered that a toner can be uniformly and finely pulverized to have a desired average particle diameter, and a release agent has a desired average dispersion diameter and is much less exposed on the surface of the toner when a pulverizability index F of the toner and an average dispersion diameter Dw of the release agent satisfy specific relationships.

The toner of the present invention has stable chargeability and good durability as well as good fluidity.

The pulverizability index F of a toner is an index of hardness of a binder resin which is a main component of the toner. The larger the index, the harder the toner and is more difficult to pulverize. The smaller the index, the more fragile the toner and is easier to pulverize.

The pulverizability index F of a toner is measured by the following method:

kneading 200 kgs of a resin with a small two-roll mill from NISHIMURA MFG. Co., Ltd., which is heated to have a temperature of 110° C. for 15 min to prepare a kneaded resin;

placing the kneaded resin into a ROTOPLX from Hosokawa Micron Corp. and crush the kneaded resin for 5 min to prepare a crushed resin;

sieving the crushed resin to prepare a resin powder passing a 16 mesh and not passing 20 mesh;

pulverizing 10.00 g of the resin powder in Mill & Mixer MM-1 from Hitachi Living Systems for 30 sec to prepare a pulverized resin; and sieving the pulverized resin with a 30-mesh sieve to measure a weight (R) g of the resin not passing the mesh; and determining a residual ratio thereof by the following formula (I):

$$F = ((R)\text{g/resin weight before pulverized } 10.00\text{ g})) \times 100 \quad (I).$$

The above-mentioned procedures are performed for 3 times and an average thereof is determined as the pulverizability index F.

Further, the pulverizability of a toner varies due to an average dispersion diameter Dw of a release agent dispersed in a binder resin of the toner with the pulverizability index F.

FIG. 1 is a diagram showing a relationship between the pulverizability index F of the toner and the average dispersion diameter Dw of the release agent of the present invention.

In FIG. 1, (i) represents an area of the following relationship (1) and (ii) represents an area of the following relationship (2).

$$F \leqq -40 \times Dw + 19 \quad (1)$$

$$F \leqq 20 \times Dw + 5 \quad (2)$$

The toner of the present invention satisfies both of the relationships (1) and (2). In FIG. 1, A represents an area the toner of the present invention satisfies.

When (1) is satisfied, the toner is uniformly pulverized. When (2) is satisfied, the toner is finely pulverized and has a small particle diameter.

Since a release agent has lower hardness and is more fragile than a binder resin, as the average dispersion diameter Dw becomes larger in a toner, fractures in the release agent and in an interface therebetween increase when pulverized. Therefore, as the average dispersion diameter Dw becomes larger, the toner becomes more difficult to uniformly pulverize.

In FIG. 1, (i) represents an area wherein the toner is uniformly pulverized.

In the area of (i), as the average dispersion diameter Dw of the release agent becomes larger, the maximum of the pulverizability index F is reduced and the pulverizability of the binder resin improves.

When a toner is in the area (i) of the relationship (1), the release agent is well dispersed in the toner and the toner has less release agent exposed on the surface thereof.

Since the release agent dispersed in the toner has a function as a core of pulverizing, the larger the average dispersion diameter Dw, the more the pulverizability of the toner improves and has smaller particle diameter after pulverized.

When the release agent is very well dispersed and has a smaller average dispersion diameter, the binder resin and the release agent are almost solved with each other in a toner and more energy is required to pulverize the toner. Therefore, the pulverizability of the toner constituents is impaired and the toner is difficult to have a smaller particle diameter.

When a toner is in both of the areas (i) and (ii), the toner can uniformly be pulverized and have a small particle diameter.

Each of the release agent and the binder resin of the toner of the present invention preferably has a viscosity in a specific range.

Figure 2:
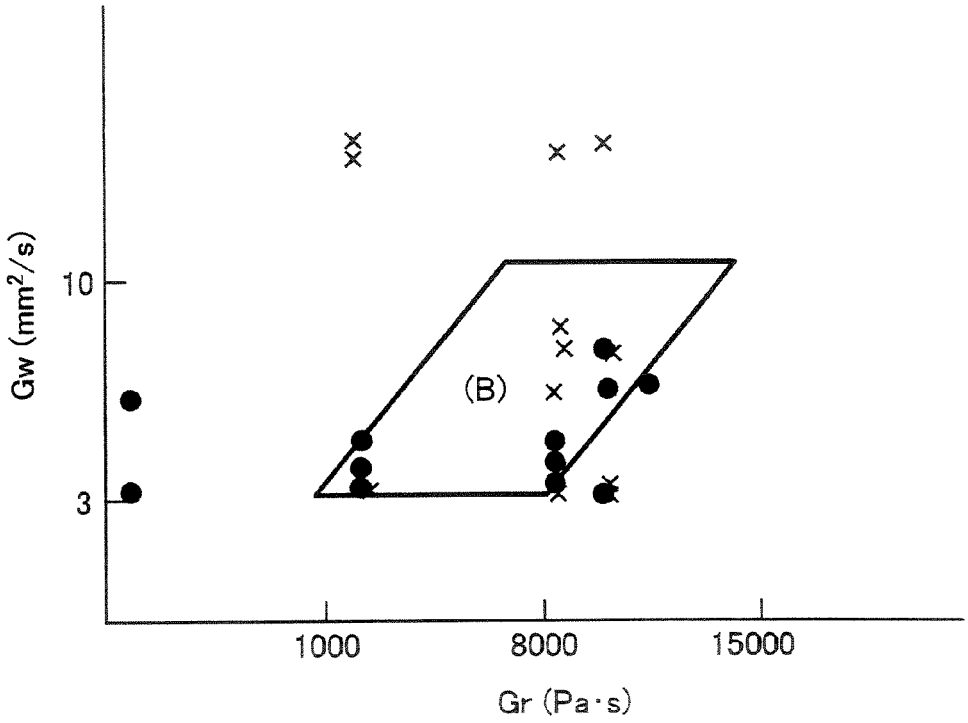
FIG. 2 is a diagram showing a relationship between the viscosity Gr (Pa·s) of the binder resin at 130° C. and the viscosity Gw of the release agent at 100° C. of the present invention.

FIG. 2 is a diagram showing a relationship between the viscosity Gr (Pa·s) of the binder resin at 130° C. and the viscosity Gw of the release agent at 100° C. of the present invention. In FIG. 2, B represents an area the toner of the present invention satisfies.

When a release agent and a binder resin each having a viscosity satisfying B, the release agent is properly controlled to uniformly disperse in the binder resin. Therefore, the release agent has a desired average dispersion diameter Dw, and the pulverizability index F of the toner and the average dispersion diameter Dw of the release agent can satisfy the above-mentioned relationships (1) and (2).

The present invention will be explained further in detail.

The toner of the present invention satisfies the following relationships:

$$2\ \mu m \leqq D4 \leqq 4\ \mu m \quad (a)$$

$$0.05\ \mu m \leqq Dw \leqq 0.3\ \mu m \quad (b)$$

$$Dw \leqq 0.075 \times D4 \quad (c)$$

wherein D4 is a weight-average particle diameter of the toner and Dw is an average dispersion diameter of the release agent, and $$F \leqq -40 \times Dw + 19 \quad (1)$$

$$F \leqq 20 \times Dw + 5 \quad (2)$$

wherein F is a pulverizability index of the toner.

When F is greater than −40×Dw+19, fractures in the release agent and in an interface between the release agent and a binder in the toner tend to occur, resulting in difficulty of uniformly dispersing toner constituents.

Namely, when the pulverizability index F of the toner and the average dispersion diameter Dw of the release agent are out of the area (i) in FIG. 1, fractures in the release agent and in an interface between the release agent and the binder resin increase when pulverized and the release agent exposed on the surface of the toner increases. In such a case, even when the weight-average particle diameter D4 of the toner and the average dispersion diameter of the release agent Dw satisfy the above-mentioned relationships, the release agent exposed on the surface of the toner increases, resulting in deterioration of the fluidity of the toner and adherence of the release agent to the surface of a carrier. When the carrier the release agent adhering to increases, the resultant developer has lower chargeability and abnormal images such as background fouling and toner scattering tend to be produced. In addition, a toner to be developed decreases and the resultant images tend to have lower image density.

On the other hand, even when the relationship (1) is satisfied, the pulverizability of the toner constituents is impaired, resulting in difficulty of preparing a toner having a small particle diameter.

The weight-average particle diameter D4 is from 2 to 4 μm.

When greater than 4 μm, the resultant images have lower quality, i.e., fine images do not have sufficient image resolution and the toner scatters on nonimage areas.

When less than 2 μm, when used long, problems such as toner scattering in image forming apparatuses, lowering of image density in a low-humidity environment and poor cleaning of a photoreceptor tend to occur, and in addition, the productivity of the toner deteriorates, resulting in high cost.

The average dispersion diameter of the release agent Dw is from 0.05 to 0.3 μm.

When greater than 0.3 μm, the release agent exposed on the surface of the toner increases, resulting in deterioration of the fluidity of the toner. Further, the release agent tends to adhere to a carrier and an image bearer in an image developer.

When less than 0.05 μm, the release agent does not have enough releasability to be hot offset resistant.

The average dispersion diameter of the release agent Dw and the weight-average particle diameter D4 of the toner and the satisfy the following relationship:

$$Dw \leqq 0.075 \times D4.$$

When Dw is greater than 0.075×D4, the release agent exposed on the surface of the toner increases, resulting in deterioration of the fluidity of the toner. Further, the release agent tends to adhere to a carrier and an image bearer in an image developer.

When Dw is not greater than 0.075×D4, the release agent is less exposed even on the surface of a toner having a weight-average particle diameter D4 of from 2 to 4 μm, and the toner has good fluidity and durability.

Further, the release agent preferably has a viscosity Gw of from 3 to 10 $mm^2/s$ at 100° C., and Gw and a viscosity (Pa·s) Gr of the binder resin at 130° C. preferably satisfy the following relationship (3):

$$(Gr/1{,}000) - 5 \leqq Gw \leqq (Gr/1{,}000) + 2 \quad (3).$$

When Gw and Gr satisfy the above-mentioned relationship, the toner satisfying the relationships (1) and (2) can be prepared after fused and kneaded.

When Gw and Gr do not satisfy the above-mentioned relationship, the release agent has an average dispersion diameter Dw out of a desired range after fused and kneaded, a balance between the pulverizability index F of the toner and the average dispersion diameter Dw of the release agent is lost, and fractures in an interface between the release agent and a binder resin increase when pulverized. Therefore, the toner has poor pulverizability and does not have a desired particle diameter.

Methods of measuring the viscosities of the binder resin and the release agent will be explained in detail in Examples mentioned later.

The toner preferably includes the release agent in an amount of from 1 to 8 parts by weight per 100 parts by weight of the binder resin.

When less than 1 part by weight, the toner is difficult to have releasability to improve the offset resistance.

When greater than 8 parts by weight, the release agent is difficult to disperse, and the fluidity of the toner deteriorates.

The toner of the present invention can use a wax as a release agent, and the wax preferably has a main peak (Mp) of from 1,000 to 2,500 when measured by GPC method.

When the main peak is less than 1,000, the dispersion particle diameter of the wax is so small that the blocking resistance of the toner deteriorates.

When greater than 2,500, the dispersion particle diameter of the wax is so large that the toner includes too much free wax to be cleaned from a photoreceptor, resulting in defective images.

The main peak is a maximum peak molecular weight in GPC.

The molecular weight distribution of the wax is measured by GPC method under the following conditions:

Measurer: GPC-150C from Waters Corp.

Column: Twin GMH-HT 30 cm from Tosoh Corp.

Temperature: 135° C.

Solvent: o-dichlorobenzene including ionol by 0.1%

Flow speed: 1.0 ml/min

Measured Sample: 0.4 ml including wax by 0.15%

A molecular weight calibration curve based on 10 monodisperse polystyrene standard samples is used when determining the molecular weight, and which is subjected to a polyethylene conversion from Mark-Houwink viscosity formula.

The wax preferably has a ratio (Mw/Mn) of the weight-average molecular weight (Mw) to the number-average molecular weight (Mn) of from 1.1 to 1.8.

When greater than 1.8, the dispersion particle diameter of the wax is difficult to control.

The toner may include two or more waxes. When the toner includes two or more waxes, at least one wax may have a Mp of from 1,000 to 2,500 and a Mw/Mn of from 1.1 to 1.8. However, each of the waxes preferably has a Mp of from 1,000 to 2,500 and a Mw/Mn of from 1.1 to 1.8.

When each of the waxes has a Mp greater than 2,500 and a Mw/Mn greater than 1.8, the dispersion particle diameter distribution of the wax becomes broad and difficult to control.

Specific examples of the release agent include synthesized waxes such as a low-molecular-weight polyethylene wax and a polypropylene wax; plant waxes such as a candelilla wax, a carnauba wax, a rice wax, a Japan wax and a jojoba oil; animal waxes such as a bees wax, lanolin and a whale wax; mineral waxes such as a montan wax and ozokelite; and fatty waxes such as a hardened ricinus, a hydroxystearic acid, a fatty acid amide and phenol fatty acid ester. These can be used alone or in combination.

Particularly, ester waxes; natural waxes such as a candelilla wax, a carnauba wax and a rice wax; and a montan wax, which have an ester bond are preferably used. Further, the carnauba wax having an ester bond is most preferably used.

A toner preferably has a weight-average particle diameter of from 2.0 to 4.0 μm, and a ratio (D4/Dn) of a weight-average particle diameter (D4) to a number-average particle diameter of from 1.00 to 1.40.

Such a toner has good thermostable storage stability, low-temperature fixability and hot offset resistance, and particularly produces full-color images having good glossiness. Typically, it is said that the smaller the toner particle diameter, the more advantageous to produce high-resolution and high-quality images. However, the more disadvantageous for transferability and cleanability of the toner, and which produce images having insufficient image density and stripes due to the poor cleanability. A toner having a weight-average particle diameter smaller than a range of the present invention is fusion bonded with the surface of a carrier in a two-component developer stirred for long periods in an image developer and deteriorates the chargeability of the carrier. When used in one-component developer, a toner film over a charging roller tends to be formed and the toner tends to be fusion bonded with a member such as a blade forming a thin toner layer. Particularly, a quantitative balance of an ultrafine powder is lost, the toner tends to be more fusion bonded with the surface of a carrier, the toner film over a charging roller tends to be more formed and the toner tends to be more fusion bonded with a member such as a blade forming a thin toner layer.

A toner having a particle diameter larger than a range of the present invention becomes difficult to produce high-resolution and high-quality images, and at the same time, a variation of particle diameter thereof becomes large in many cases when the toner is consumed and fed long in a developer.

When D4/Dn is greater than 1.40, the toner has a wide charge quantity and produces images having lower image resolution. A method of measuring an average particle diameter and a particle diameter distribution will be explained in detail in Examples mentioned later.

A toner preferably includes fine particles having a diameter not greater than 1.0 μm in an amount of 10% or less by number for improving the fluidity and durability.

The toner of the present invention includes at least a binder resin, a colorant, a release agent and charge controlling agent. Any resins having conventionally been used as binder resins for toners can be used. Specific examples thereof include styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

Specific examples of the colorants for use in the present invention include any known dyes and pigments such as carbon black, Nigrosine dyes, black iron oxide, NAPHTHOL YELLOWS, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination. The toner particles preferably include the colorant in an amount of from 1 to 15% by weight, and more preferably from 3 to 10% by weight.

Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes), BONTRON P-51 (quaternary ammonium salt), BONTRONS-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

An inorganic particulate material is preferably used as an external additive to improve the fluidity and developability and chargeability of a toner. The inorganic particulate material preferably has a primary particle diameter of from 5 mu to 2 μm, and more preferably from 5 mp to 500 mu. In addition, the inorganic particulate material preferably has a specific surface area of from 20 to 500 $m^2/g$ when measured by BET method. A toner preferably includes the inorganic particulate material in an amount of from 0.01 to 5% by weight, and more preferably from 0.01 to 2.0% by weight.

Specific preferred examples of the suitable inorganic particulate materials include silica, titanium oxide, alumina, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

A surface treatment agent can increase the hydrophobicity of the external additives and prevent deterioration of fluidity and chargeability of the resultant toner even in high humidity. Any desired surface treatment agent may be used, depending on the properties of the treated particle of interest. Specific preferred examples of the surface treatment agent include silane coupling agents, silylating agents, silane coupling agents having an alkyl fluoride group, organic titanate coupling agents, aluminium coupling agents silicone oils and modified silicone oils.

Specific examples of a method of manufacturing the toner of the present invention include:

mixing well a binder resin, a pigment or a dye as a colorant, a release agent and other additives with a mixer such as HENSCHEL MIXER;

kneading well the resultant mixture upon application of heat with a continuous biaxial extruder such as KTK biaxial extruder from Kobe Steel, Ltd., TEM biaxial extrude from Toshiba Machine Co., Ltd., TEX biaxial extruder from Japan Steel Works, Ltd., PCM biaxial extruder from Ikegai Corporation and KEX biaxial extruder or a continuous uniaxial kneader such as KO-KNEADER from Buss AG and a kneader from KCK Co., Ltd., when a kneading amount or temperature is lowered such that the kneaded mixture has high viscosity to increase a specific energy;

crushing the kneaded mixture with a hammer mill, etc. and pulverizing the crushed mixture with a pulverizer such as a jet stream pulverizer and a mechanical pulverizer;

classifying the pulverized mixture with a classifier such as a classifier using rotary stream or Coanda effect to prepare a toner having a desired diameter; and then mixing well the toner and an inorganic fine powder with a mixer such as HENSCHEL MIXER and sieving the mixture through a screen having not less than 250 mesh to remove large and agglomerated particles to prepare the toner of the present invention.

Besides this method, the toner of the present invention can be prepared by polymerization methods such as a suspension polymerization method, a dispersion polymerization method and an emulsion polymerization method or known methods such as a microcapsule polymerization method and a spray dry method.

The toner of the present invention can be mixed with a magnetic carrier to be used as a two-component developer, and can also be used as a one-component developer without the magnetic carrier.

Known carriers for two-component developers can be used as the magnetic carrier. Specific examples thereof include magnetic particulate materials such as iron and ferrite; resin-coated magnetic particulate materials; and binder carriers wherein a magnetic fine powder is dispersed in a binder resin.

Particularly, the resin-coated magnetic particulate materials coated with silicone resins, graft copolymer resins of organopolysiloxane and vinyl monomers or polyester resins are preferably used. Further, the resin-coated magnetic particulate materials coated with resins wherein isocyanate is reacted with the graft copolymer resins of organopolysiloxane and vinyl monomers are more preferably used in terms of durability and environment resistance. The vinyl monomers need to have substituents such as hydroxyl groups reactive with isocyanate. The magnetic carrier preferably has a volume-average particle diameter of from 20 to 100 μm, and more preferably from 20 to 60 μm.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

[Synthesis of Polyester Resin 1]

The following materials were reacted in a reaction tank having a thermometer, a stirrer, a cooler and a nitrogen inlet tube at 230° C. to prepare a polyester resin 1 having an acid value of 7.

| | |
|---|---|
| Adduct of bisphenol A with propyleneoxide (having a hydroxyl value of 320) | 443 |
| Diethylene glycol | 135 |
| Terephthalic acid | 422 |
| Dibutyltinoxide | 2.5 |

The resin had a glass transition temperature (Tg) of 65° C., a peak molecular weight of 16,000 and a pulverizability index of 8.8.

[Synthesis of Polyester Resin 2]

The following materials were reacted in a reaction tank having a thermometer, a stirrer, a cooler and a nitrogen inlet tube at 230° C. to prepare a polyester resin 2 having an acid value of 6.

| | |
|---|---|
| Adduct of bisphenol A with ethyleneoxide (having a hydroxyl value of 340) | 750 |
| Terephthalic acid | 250 |
| Dibutyltinoxide | 2.5 |

The resin had a glass transition temperature (Tg) of 70° C., a peak molecular weight of 20,500 and a pulverizability index of 10.5.

[Synthesis of Styrene Acrylic Resin 1]

After 646 parts of xylene was nitrogen-substituted in an autoclave reaction tank having a thermometer, a stirrer, a cooler and a nitrogen inlet tube, a mixed monomer including 200 parts of acrylonitrile, 689 parts of styrene and a 114 parts of 2-ethylhexylacrylate were added therein, and further a polymerization initiator including 118 parts of xylene and 52 parts of di-t-butylperoxide were dropped therein at 170° C. for 3 hrs, and the reaction product was subjected to de-solvent to prepare a styrene acrylic resin 1. The resin had a weight-average molecular weight of 4,700, a number-average molecular weight of 2,300, a Tg of 55° C. and a pulverizability index of 2.1.

[Synthesis of Hybrid Resin 1]

In a mixture of 332 g of styrene, 83 g of 2-ethylhexylacrylate, 8 g of an acrylic acid and 42 g of dicumylperoxide (polymerization initiator), a mixture of 700 g of an adduct of bisphenol A with 2.2 mol of propyleneoxide, 166 g of terephthalic acid and 107 g of isododecenyl succinate anhydride, and a mixture of 115 g of trimellitic acid and 20 g of dibutyltinoxide (esterification catalyst) were dropped in a nitrogen atmosphere at 160° C. for 1 hr. The mixture was further subjected to a reaction at 160° C. for another 2 hrs, heated to have a temperature of 230° C., and was further subjected to a reaction under reduced pressure to prepare a hybrid resin 1. The resin had a softening point of 143.2° C., a Tg of 65.5° C., an acid value of 26.2 mg KOH/g, a THF-insoluble component of 23.2% and a pulverizability index of 7.1.

[Synthesis of Hybrid Resin 2]

After 1,225 g of polyoxypropylene(2.2)-2,2-(4-hydroxyphenyl)propane, 485 g of polyoxypropylene(2.0)-2,2-(4-hydroxyphenyl)propane, 345 g of terephthalic acid and 250 g of isododecenyl succinate as condensation polymerization resin monomer materials, and 5 g of dibutyltinoxide (esterification catalyst) were condensation-polymerized in a nitrogen atmosphere at 230° C. for 6 hrs, the condensation-polymerized product was cooled to have a temperature of 160° C. After 175 g of trimellitic acid were added thereto, a mixture of 476 g of styrene, 105 g of 2-ethylhexylacrylate and 35 g of an acrylic acid as addition polymerization resin monomer materials and 25 g of dicumylperoxide as a polymerization initiator was dropped therein at 160° C. for 1 hr while stirred. The mixture was further subjected to an addition polymerization at 160° C. for another 1 hr, heated to have a temperature of 200° C. to be subjected to a condensation polymerization. The mixture was further reacted until having a softening point of 120° C. when measured by ASTM E28-67 to prepare a hybrid resin 2. The resin a Tg of 58° C., an acid value of 22.5 mg KOH/g and a pulverizability index of 4.8.

[Synthesis of Hydrogenated Petroleum Resin 1]

After 154 g of xylene was placed in a 1-litter nitrogen-substituted autoclave having a stirrer and heated to have a temperature of 230° C., a mixture of 269 g of dicyclopentadiene and 269 g of xylene was added thereto for 2 hrs while stirred. Then, the reaction liquid was heated to have a temperature of 260° C. for 105 min and subjected to a reaction for 4 hrs. After the reaction, an unreacted monomer and xylene were removed from the reaction liquid in a rotary evaporator at 200° C. and 10 mm Hg for 3 hrs to prepare 510 g of a copolymer resin of dicyclopentadiene and styrene. The resin had a softening point of 115° C. and a bromine value 54 g/100 g, and included an aromatic ring of 43% by weight.

Further, 75 g of cyclohexane, 75 g of the resin and 4.0 g of silica-alumina catalyst bearing palladium of 0.5% by weight were placed in a 300-ml nitrogen-substituted autoclave having a stirrer, and the mixture was hydrogenated at a hydrogen pressure of 4 Mpa and 150° C. for 2 hrs. The reaction product was cooled and filtered to remove the catalyst, and further distilled to remove the solvent to prepare a hydrogenated petroleum resin 1. The resin had a softening point of 120° C. and a bromine value 14 g/100 g, and included an aromatic ring of 43% by weight. Further, the resin had an ethylene double bond having a hydrogenation of 74%, an aromatic ring having a hydrogenation of 0% and a pulverizability index of 0.5.

Hereinafter, a method of synthesizing a masterbatch used for preparing the toner of the present invention will be explained.

The following toner constituents were mixed with HENSCHEL MIXER (20B from Mitsui Mining Co., Ltd.) at 1,500 rpm for 3 min to prepare a mixture.

| | |
|---|---|
| Water | 25 |
| Carbon black (#C-44 from Mitsubishi Chemical Corp.) | 50 |
| Polyester resin | 50 |

(linear polyester, formed of an adduct of bisphenol A with propyleneoxide or ethyleneoxide, having a Tg of 60° C., a Mw of 25,000 and a Mp of 115° C.)

The mixture was kneaded with a two-roll mixer at 120° C. for 45 min to prepare a kneaded mixture, and the kneaded mixture was rolled, cooled and pulverized with a pulverizer to prepare a masterbatch 1.

The above-mentioned procedure was repeated to prepare masterbatches having other colors except for replacing carbon black with the following colorants.

Yellow colorant: Benzimidazolone pigment (Pigment Yellow 180 NOVOPERM YELLOW P-HG from Clariant(Japan)K.K.)

Magenta colorant: Quinacridone pigment (Pigment Red 146, 147 PERMANENT RUBINE F6B from Clariant(Japan)K.K.)

Cyan colorant: Copper phthalocyanine pigment (Pigment Blue 15:3 LIONOL BLUE 7351 from Toyo Ink Mfg. Co., Ltd.)

Example 1

The following toner constituents were mixed with HENSCHEL MIXER (20B from Mitsui Mining Co., Ltd.) at 1,500 rpm for 3 min to prepare a mixture.

| | |
|---|---|
| Polyester resin 1 | 47.5 |
| Styrene acrylic resin 1 | 47.5 |
| Paraffin wax (120 from NIPPON SEIRO CO., LTD) | 5 |
| Masterbatch 1 | 10 |

The mixture was kneaded with a small uniaxial kneader KO-KNEADER from Buss AG at an entrance temperature of 100° C., an exit temperature of 50° C. and a feeding amount of 2 kg/hr to prepare a mother toner 1.

The mother toner 1 was rolled, cooled and pulverized with a pulverizer, and further fine-pulverized I-type mill IDS-2 using a flat impinging plate from Nippon Pneumatic Mfg. Co., Ltd. at an air pressure 6.8 atm/cm$^2$ and a feeding amount of 0.5 kg/hr. The fine-pulverized mother toner 1 was further classified with a classifier 132 MP from Alpine American Corp. to prepare a particulate mother toner 1.

The following materials were mixed with HENSCHEL MIXER (20B from Mitsui Mining Co., Ltd.) at a peripheral speed of 30 m/sec by repeating 5 times of mixing for 30 sec and pausing for 60 sec to prepare a toner 1.

| | |
|---|---|
| Particulate mother toner I | 100 |
| External additive A (hydrophobic silica having a primary particle diameter of 10 nm) | 1.0 |
| External additive B (almost spherical hydrophobized silica with hexamethyldisilazane, formed by a sol-gel method, having a primary particle diameter of 110 nm) | 1.5 |
| External additive C (hydrophobic titanium oxide having a primary particle diameter of 15 nm) | 1.0 |

The toner 1 had a weight-average particle diameter (D4) of 3.8 μm and a number-average particle diameter (Dn) of 3.1 μm, and the wax therein had an average dispersion diameter (Dw) of 2.8 μm.

Example 2

The procedure for preparation of the toner 1 in Example 1 was repeated to prepare a toner 2 except for changing the toner constituents as follows.

| | |
|---|---|
| Polyester resin 1 | 75 |
| Styrene acrylic resin 1 | 20 |
| Paraffin wax (140 from NIPPON SEIRO CO., LTD) | 5 |
| Masterbatch 1 | 10 |

The toner 2 had a weight-average particle diameter (D4) of 3.0 μm and a number-average particle diameter (Dn) of 2.4 μm, and the wax therein had an average dispersion diameter (Dw) of 0.24 μm.

Example 3

The procedure for preparation of the toner 1 in Example 1 was repeated to prepare a toner 3 except for changing the quantities of the toner constituents as follows.

| | |
|---|---|
| Polyester resin 1 | 65 |
| Styrene acrylic resin 1 | 30 |
| Paraffin wax (130 from NIPPON SEIRO CO., LTD) | 6 |
| Masterbatch 1 | 10 |

The toner 3 had a weight-average particle diameter (D4) of 2.3 μm and a number-average particle diameter (Dn) of 1.8 μm, and the wax therein had an average dispersion diameter (Dw) of 0.20 μm.

Example 4

The procedure for preparation of the toner 1 in Example 1 was repeated to prepare a toner 4 except for changing the quantities of the toner constituents as follows.

| | |
|---|---|
| Hybrid resin 1 | 95 |
| Paraffin wax (155 from NIPPON SEIRO CO., LTD) | 4 |
| Masterbatch 1 | 10 |

The toner 4 had a weight-average particle diameter (D4) of 3.7 μm and a number-average particle diameter (Dn) of 2.9 μm, and the wax therein had an average dispersion diameter (Dw) of 0.14 μm.

Example 5

The procedure for preparation of the toner 1 in Example 1 was repeated to prepare a toner 5 except for changing the quantities of the toner constituents as follows.

| | |
|---|---|
| Hybrid resin 1 | 95 |
| Microcrystalline wax (Hi-Mic2065 from NIPPON | 7 |

-continued

| | |
|---|---|
| SEIRO CO., LTD) | |
| Masterbatch 1 | 10 |

The toner 5 had a weight-average particle diameter (D4) of 2.3 μm and a number-average particle diameter (Dn) of 1.9 μm, and the wax therein had an average dispersion diameter (Dw) of 0.07 μm.

Example 6

The procedure for preparation of the toner 1 in Example 1 was repeated to prepare a toner 6 except for changing the quantities of the toner constituents as follows.

| | |
|---|---|
| Polyester resin 2 | 47.5 |
| Hydrogenated petroleum resin 1 | 47.5 |
| Paraffin wax (120 from NIPPON SEIRO CO., LTD) | 5 |
| Masterbatch 1 | 10 |

The toner 6 had a weight-average particle diameter (D4) of 3.4 μm and a number-average particle diameter (Dn) of 2.6 μm, and the wax therein had an average dispersion diameter (Dw) of 0.20 μm.

Example 7

The procedure for preparation of the toner 1 in Example 1 was repeated to prepare a toner 7 except for changing the quantities of the toner constituents as follows.

| | |
|---|---|
| Polyester resin 2 | 70 |
| Hydrogenated petroleum resin 1 | 25 |
| Fischer-Tropsch wax (FT-0070 from NIPPON SEIRO CO., LTD) | 6 |
| Masterbatch 1 | 10 |

The toner 7 had a weight-average particle diameter (D4) of 3.8 μm and a number-average particle diameter (Dn) of 3.0 μm, and the wax therein had an average dispersion diameter (Dw) of 0.27 μm.

Comparative Example 1

The procedure for preparation of the toner 1 in Example 1 was repeated to prepare a toner 8 except for changing the quantities of the toner constituents as follows.

| | |
|---|---|
| Polyester resin 1 | 95 |
| Microcrystalline wax (Hi-Mic2065 from NIPPON SEIRO CO., LTD) | 6 |
| Masterbatch 1 | 10 |

The toner 8 had a weight-average particle diameter (D4) of 4.3 μm and a number-average particle diameter (Dn) of 3.5 μm, and the wax therein had an average dispersion diameter (Dw) of 0.17 μm.

Comparative Example 2

The procedure for preparation of the toner 1 in Example 1 was repeated to prepare a toner 9 except for changing the quantities of the toner constituents as follows.

| | |
|---|---|
| Polyester resin 1 | 95 |
| Fischer-Tropsch wax (FT-0070 from NIPPON SEIRO CO., LTD) | 5 |
| Masterbatch 1 | 10 |

The toner 9 had a weight-average particle diameter (D4) of 3.7 μm and a number-average particle diameter (Dn) of 2.1 μm, and the wax therein had an average dispersion diameter (Dw) of 0.30 μm.

Comparative Example 3

The procedure for preparation of the toner 1 in Example 1 was repeated to prepare a toner 10 except for changing the quantities of the toner constituents as follows.

| | |
|---|---|
| Polyester resin 2 | 95 |
| Paraffin wax (120 from NIPPON SEIRO CO., LTD) | 5 |
| Masterbatch 1 | 10 |

The toner 10 had a weight-average particle diameter (D4) of 3.0 μm and a number-average particle diameter (Dn) of 1.8 μm, and the wax therein had an average dispersion diameter (Dw) of 0.24 μm.

Comparative Example 4

The procedure for preparation of the toner 1 in Example 1 was repeated to prepare a toner 11 except for changing the quantities of the toner constituents as follows.

| | |
|---|---|
| Polyester resin 2 | 80 |
| Styrene acrylic resin 1 | 15 |
| Paraffin wax (120 from NIPPON SEIRO CO., LTD) | 5 |
| Masterbatch 1 | 10 |

The toner 11 had a weight-average particle diameter (D4) of 2.5 μm and a number-average particle diameter (Dn) of 1.6 μm, and the wax therein had an average dispersion diameter (Dw) of 0.21 μm.

Comparative Example 5

The procedure for preparation of the toner 1 in Example 1 was repeated to prepare a toner 12 except for changing the quantities of the toner constituents as follows.

| | |
|---|---|
| Polyester resin 1 | 80 |
| Styrene acrylic resin 1 | 15 |
| Microcrystalline wax (Hi-Mic1080 from NIPPON SEIRO CO., LTD) | 5 |
| Masterbatch 1 | 10 |

The toner 12 had a weight-average particle diameter (D4) of 2.5 μm and a number-average particle diameter (Dn) of 1.6 μm, and the wax therein had an average dispersion diameter (Dw) of 0.21 μm.

Comparative Example 6

The procedure for preparation of the toner 1 in Example 1 was repeated to prepare a toner 13 except for changing the quantities of the toner constituents as follows.

| | |
|---|---|
| Polyester resin 2 | 25 |
| Styrene acrylic resin 1 | 70 |
| Microcrystalline wax (Hi-Mic1080 from NIPPON SEIRO CO., LTD) | 5 |
| Masterbatch 1 | 10 |

The toner 13 had a weight-average particle diameter (D4) of 3.0 μm and a number-average particle diameter (Dn) of 2.2 μm, and the wax therein had an average dispersion diameter (Dw) of 0.10 μM.

Comparative Example 7

The procedure for preparation of the toner 1 in Example 1 was repeated to prepare a toner 14 except for changing the quantities of the toner constituents as follows.

| | |
|---|---|
| Polyester resin 1 | 47.5 |
| Styrene acrylic resin 1 | 47.5 |
| Paraffin wax (115 from NIPPON SEIRO CO., LTD) | 5 |
| Masterbatch 1 | 10 |

The toner 14 had a weight-average particle diameter (D4) of 4.0 μm and a number-average particle diameter (Dn) of 3.2 μm, and the wax therein had an average dispersion diameter (Dw) of 0.33 μm.

Comparative Example 8

The procedure for preparation of the toner 1 in Example 1 was repeated to prepare a toner 15 except for changing the quantities of the toner constituents as follows.

| | |
|---|---|
| Polyester resin 1 | 47.5 |
| Polyester resin 2 | 47.5 |
| Microcrystalline wax (Hi-Mic2065 from NIPPON SEIRO CO., LTD) | 5 |
| Masterbatch 1 | 10 |

The toner 15 had a weight-average particle diameter (D4) of 3.3 μm and a number-average particle diameter (Dn) of 2.2 μm, and the wax therein had an average dispersion diameter (Dw) of 0.27 μm.

The binder resin compositions and properties in toners 1 to 15 are shown in Tables 1-1 and 1-2, and the particle diameters and pulverizability indices thereof and properties and average dispersion diameters of waxes therein are shown in Table 2.

The following items were evaluated by the following methods.

(1) The Weight-Average Particle Diameter and Number-Average Particle Diameter of Toner The average particle diameter and particle diameter distribution of the toner can be measured by a Coulter counter TA-II from Beckman Coulter, Inc. as follows:

0.1 to 5 ml of a detergent, preferably alkylbenzene sulfonate is included as a dispersant in 100 to 150 ml of the electrolyte ISOTON R-II from Coulter Scientific Japan, Ltd., which is a NaCl aqueous solution including an elemental sodium content of 1%;

2 to 20 mg of a toner sample is included in the electrolyte to be suspended therein, and the suspended toner is dispersed by an ultrasonic disperser for about 1 to 3 min to prepare a sample dispersion liquid; and a volume and a number of the toner particles for each of the following 12 channels are measured by the above-mentioned measurer using an aperture of 100 μm to determine a weight distribution and a number distribution:

1.26 to less than 1.59 μm; 1.59 to less than 2.00 μm; 2.00 to less than 2.52 μm; 2.52 to less than 3.17 μm; 3.17 to less than 4.00 μm; 4.00 to less than 5.04 μm; 5.04 to less than 6.35 μm; 6.35 to less than 8.00 μm; 8.00 to less than 10.08 μm; 10.08 to less than 12.70 μm; 12.7 to less than 16.00 μm; and 16.00 to less than 20.20 μm.

(2) Toner Pulverizability

The pulverizability index F of a toner is measured by the following method:

kneading 200 kgs of a resin with a small two-roll mill from NISHIMURA MFG. Co., Ltd., which is heated to have a temperature of 110° C. for 15 min to prepare a kneaded resin;

placing the kneaded resin into a ROTOPLX from Hosokawa Micron Corp. and crush the kneaded resin for 5 min to prepare a crushed resin;

sieving the crushed resin to prepare a resin powder passing a 16 mesh and not passing 20 mesh;

pulverizing 10.00 g of the resin powder in Mill & Mixer MM-1 from Hitachi Living Systems for 30 sec to prepare a pulverized resin; and sieving the pulverized resin with a 30-mesh sieve to measure a weight (R) g of the resin not passing the mesh; and determining a residual ratio thereof by the following formula (I):

$$F=((R)\text{g/resin weight before pulverized 10.00 g}))\times 100 \quad \text{(I).}$$

(3) Average Dispersion Diameter of Wax

In the present invention, the dispersion diameter of the wax is the longest particle diameter of a wax.

Specifically, the toner is embedded in an epoxy resin, which is sliced to have a thickness of about 100 μm, and which is dyed with ruthenium tetroxide. A cross-section of the dyed slice is observed by a transmission electron microscope (TEM) at 10,000-fold magnification and 20 images of the toner are photographed to see the dispersion status and measure the particle diameter of the wax. When amorphous, an average of the longest diameter and shortest diameter is the average dispersion diameter of the wax.

(4) Wax Viscosity

The wax viscosity (Gw) is measured with a rotating viscometer VT-500 from HAAKE GmbH under the following conditions.

Measurement temperature: 100° C.

Wax weight: 10 to 50 mg

Cone: HAAKE PK1;0.5

Stress: $1/6{,}000$ sec (5) Binder Resin Viscosity

The binder resin viscosity (Gr) is measured with a flow tester CFT-500 from Shimadzu Corp. at a load of 10 kg/cm$^2$, an orifice diameter of 1 mm and a length of 1 mm and a rate of temperature increase of 5° C./min. Gr is a viscosity at 130° C.

TABLE 1-1

| | Binder Resin A | | | | |
|---|---|---|---|---|---|
| | Resin | Gr [Pa · s] (130° C.) | Molecular Weight not greater than 1,000 [%] | F | Ratio to total weight of resin [%] |
| Example 1 | Polyester resin 1 | 8,600 | 5 | 8.8 | 47.5 |
| Example 2 | Polyester resin 1 | 8,600 | 5 | 8.8 | 75 |
| Example 3 | Polyester resin 1 | 8,600 | 5 | 8.8 | 65 |
| Example 4 | Hybrid resin 1 | 11,000 | 4 | 7.1 | 95 |
| Example 5 | Hybrid resin 2 | 10,500 | 3 | 4.8 | 95 |
| Example 6 | Polyester resin 2 | 10,500 | 3 | 10.5 | 47.5 |
| Example 7 | Polyester resin 2 | 10,500 | 3 | 10.5 | 70 |
| Comparative Example 1 | Polyester resin 1 | 8,600 | 5 | 8.8 | 95 |
| Comparative Example 2 | Polyester resin 1 | 8,600 | 5 | 8.8 | 95 |
| Comparative Example 3 | Polyester resin 2 | 10,500 | 3 | 10.5 | 95 |
| Comparative Example 4 | Polyester resin 2 | 10,500 | 3 | 10.5 | 80 |
| Comparative Example 5 | Polyester resin 1 | 8,600 | 5 | 8.8 | 80 |
| Comparative Example 6 | Polyester resin 2 | 10,500 | 3 | 10.5 | 25 |
| Comparative Example 7 | Polyester resin | 8,600 | 5 | 8.8 | 47.5 |
| Comparative Example 8 | Polyester resin 1 | 8,600 | 5 | 8.8 | 47.5 |

TABLE 1-2

| | Binder Resin B | | | | |
|---|---|---|---|---|---|
| | Resin | Gr [Pa · s] (130° C.) | Molecular Weight not greater than 1,000 [%] | F | Ratio to total weight of resin [%] |
| Example 1 | Styrene acrylic resin 1 | 1,500 | 22 | 2.1 | 47.5 |
| Example 2 | Styrene acrylic resin 1 | 1,500 | 22 | 2.1 | 20 |
| Example 3 | Styrene acrylic resin 1 | 1,500 | 22 | 2.1 | 30 |
| Example 4 | — | — | — | — | — |
| Example 5 | — | — | — | — | — |
| Example 6 | Hydro-genated petroleum resin 1 | 13 | 20 | 0.5 | 47.5 |
| Example 7 | Hydro-genated petroleum resin 1 | 13 | 20 | 0.5 | 25 |
| Comparative Example 1 | — | — | — | — | — |
| Comparative Example 2 | — | — | — | — | — |
| Comparative Example 3 | — | — | — | — | — |
| Comparative Example 4 | Styrene acrylic resin 1 | 1,500 | 22 | 2.1 | 15 |
| Comparative | Styrene | 1,500 | 22 | 2.1 | 15 |

TABLE 1-2-continued

| | Binder Resin B | | | | |
|---|---|---|---|---|---|
| | Resin | Gr [Pa · s] (130° C.) | Molecular Weight not greater than 1,000 [%] | F | Ratio to total weight of resin [%] |
| Example 5 | acrylic resin 1 | | | | |
| Comparative Example 6 | Styrene acrylic resin 1 | 1,500 | 22 | 2.1 | 70 |
| Comparative Example 7 | Styrene acrylic resin 1 | 1,500 | 22 | 2.1 | 47.5 |
| Comparative Example 8 | Polyester resin 2 | 10,500 | 3 | 10.5 | 47.5 |

TABLE 2

| | Toner | | | | Wax | | |
|---|---|---|---|---|---|---|---|
| | D4 [μm] | Dn [μm] | D4/Dn | F | Dw [μm] | Gw (100° C.) [mm²/s] | Parts by weight |
| Example 1 | 3.8 | 3.1 | 1.23 | 4.1 | 0.28 | 3.1 | 5 |
| Example 2 | 3.0 | 2.4 | 1.25 | 7.8 | 0.24 | 4.1 | 5 |
| Example 3 | 2.3 | 1.8 | 1.28 | 7.1 | 0.20 | 3.8 | 6 |
| Example 4 | 3.7 | 2.9 | 1.28 | 6.8 | 0.14 | 6.4 | 4 |
| Example 5 | 2.3 | 1.9 | 1.21 | 4.2 | 0.07 | 8.2 | 7 |
| Example 6 | 3.4 | 2.6 | 1.31 | 3.1 | 0.20 | 3.1 | 5 |
| Example 7 | 3.8 | 3.0 | 1.27 | 6.8 | 0.27 | 5.8 | 6 |
| Comparative Example 1 | 4.3 | 3.5 | 1.23 | 8.9 | 0.17 | 8.2 | 6 |
| Comparative Example 2 | 3.7 | 2.1 | 1.76 | 8.9 | 0.30 | 5.8 | 5 |
| Comparative Example 3 | 3.0 | 1.8 | 1.67 | 10.6 | 0.24 | 3.1 | 5 |
| Comparative Example 4 | 2.5 | 1.6 | 1.56 | 9.7 | 0.21 | 3.1 | 5 |
| Comparative Example 5 | 1.8 | 1.2 | 1.50 | 7.5 | 0.10 | 15.1 | 5 |
| Comparative Example 6 | 3.0 | 2.2 | 1.36 | 4.2 | 0.03 | 15.6 | 6 |
| Comparative Example 7 | 4.0 | 3.2 | 1.25 | 4.2 | 0.33 | 3.0 | 5 |
| Comparative Example 8 | 3.3 | 2.2 | 1.50 | 9.8 | 0.27 | 8.2 | 5 |

Each of Dw and F of Examples 1 to 7 (●) and Comparative Examples 1 to 8 (X) were plotted in FIG. 1.

Each of Gr and Gw of Examples 1 to 7 (●) and Comparative Examples 1 to 8 (X) were plotted in FIG. 2.

Next, 7% by weight of each of the toners 1 to 15 and 93% by weight of a ferrite carrier having an average particle diameter of 35 μm were mixed with a tubular mixer for 10 min to prepare a two-component developer for each color, yellow, magenta, cyan and black.

Images were produced on Ricoh 6200 papers by Imagio Neo C285 using the two-component developers to evaluate fixable minimum temperatures and fixable maximum temperatures. Further, 100,000 images having each color by 5% each were produced on Ricoh 6200 papers to evaluate image densities, background foulings, developer charge quantities and developer toner concentrations. The evaluation methods and standards are as follows.

<Aggregation>

Powder tester PT-N from Hosokawa Micron Corp. was used. Specifically, 2.0 g of the toner were passed through sieves (JIS Z 8801-1 plain-woven wire) having an opening of 150, 75 and 45 μm respectively at a vibration amplitude of 1 mm and a vibration time of 30 sec. An amount of the residual toner on each of the sieves after vibrated was measured and the aggregation was determined from the following formula (4):

$$\text{Aggregation (\%)}=(X+0.6Y+0.2Z)/2.0\times 100$$

wherein X is an amount of the residual toner on the sieve having an opening of 150 μm; Y is an amount of the residual toner on the sieve having an opening of 75 μm; and Z is an amount of the residual toner on the sieve having an opening of 45 μm.

In the present invention, the aggregation is an index of the fluidity.

When the aggregation is 20% or less, the fluidity of the toner is satisfactory.

The aggregation is more preferably 15% or less.

<Image Density>

An average of image densities of 5 points on a monochrome solid image measured with Macbeth densitometer was determined as the imaged density.

<Background Fouling>

After a PRINTAC was attached to a non-image area of a photoreceptor and peeled off therefrom, the PRINTAC was attached onto a blank Ricoh 6200 paper and image densities of 5 points thereof were measured with Macbeth densitometer and an average thereof was determined. A difference between the average and an image density of just a PRINTAC simply attached thereto was determined as background fouling density.

<Developer Charge Quantity and Toner Concentration>

The charge quantity of the developer was measured with a blow-off powder charge quantity measurer from Toshiba Chemical Corp. The developer was placed in a measurement gauge a mesh having 635 openings was set in and blown off for 30 sec to measure a charge quantity Q (μC) and a mass M (g) of scattered powders. The developer charge quantity Q/M (μC/g) and toner concentration TC (% by weight) were determined from the charge quantity Q (μC) and mass M (g).

When the developer charge quantity is from 30 to 50 μC/g, the fixed images have less abnormal images and less deterioration of image density.

<Fixable Minimum and Maximum Temperatures>

The surface temperature of a fixing belt installed in Imagio Neo C285 was changed from 120 to 250° C. at a unit of 5° C. such that a solid image has a toner adherence of 0.50±0.03 mg/cm$^2$.

The fixable minimum temperature was a temperature of the fixing belt, at which the image density was not less than 70% after scraped with a pat. The fixable maximum temperature was a temperature at which offset did not occur.

The results of the evaluations are shown in Tables 3-1, 3-2 and 3-3, wherein the cyan toner was used as a representative of each color.

TABLE 3-1

| | | Image Quality | | | |
|---|---|---|---|---|---|
| | | Image Density | | Background fouling | |
| | Aggregation [%] | Initial | After 100,000 | Initial | After 100,000 |
| Example 1 | 10 | 1.45 | 1.47 | 0.00 | 0.01 |
| Example 2 | 11 | 1.43 | 1.44 | 0.00 | 0.02 |
| Example 3 | 9 | 1.44 | 1.46 | 0.01 | 0.03 |
| Example 4 | 8 | 1.47 | 1.44 | 0.00 | 0.01 |
| Example 5 | 13 | 1.43 | 1.45 | 0.00 | 0.02 |
| Example 6 | 10 | 1.46 | 1.43 | 0.00 | 0.0 |
| Example 7 | 12 | 1.45 | 1.46 | 0.01 | 0.02 |
| Comparative Example 1 | 11 | 1.45 | 1.36 | 0.01 | 0.11 |
| Comparative Example 2 | 32 | 1.43 | 1.34 | 0.00 | 0.09 |
| Comparative Example 3 | 33 | 1.46 | 1.30 | 0.00 | 0.11 |
| Comparative Example 4 | 28 | 1.45 | 1.32 | 0.01 | 0.15 |
| Comparative Example 5 | 24 | 1.45 | 1.30 | 0.00 | 0.16 |
| Comparative Example 6 | 13 | 1.45 | 1.31 | 0.00 | 0.14 |
| Comparative Example 7 | 26 | 1.44 | 1.30 | 0.04 | 0.15 |
| Comparative Example 8 | 30 | 1.45 | 1.29 | 0.01 | 0.14 |

TABLE 3-2

| | Developer | | | |
|---|---|---|---|---|
| | Q | | TC | |
| | Initial | After 100,000 | Initial | After 100,000 |
| Example 1 | 32 | 30 | 7.0 | 6.6 |
| Example 2 | 35 | 32 | 7.1 | 6.7 |
| Example 3 | 33 | 34 | 6.9 | 6.5 |
| Example 4 | 36 | 33 | 7.0 | 6.8 |
| Example 5 | 29 | 30 | 7.1 | 6.6 |
| Example 6 | 30 | 26 | 7.1 | 6.7 |
| Example 7 | 35 | 33 | 6.9 | 6.5 |
| Comparative Example 1 | 30 | 15 | 7.0 | 5.2 |
| Comparative Example 2 | 38 | 16 | 7.1 | 5.5 |
| Comparative Example 3 | 28 | 14 | 7.0 | 5.0 |
| Comparative Example 4 | 30 | 13 | 6.9 | 4.5 |
| Comparative Example 5 | 26 | 12 | 7.0 | 4.3 |
| Comparative Example 6 | 27 | 14 | 7.1 | 4.8 |
| Comparative Example 7 | 30 | 15 | 7.0 | 4.9 |
| Comparative Example 8 | 36 | 14 | 7.0 | 5.2 |

TABLE 3-3

| | Fixability | | |
|---|---|---|---|
| | Fixable Minimum Temperature [° C.] | Fixable Maximum Temperature [° C.] | Total Quality |
| Example 1 | 150 | Not less than 210 | ○ |
| Example 2 | 145 | Not less than 210 | ○ |
| Example 3 | 145 | Not less than 210 | ○ |

TABLE 3-3-continued

| | Fixability | | |
|---|---|---|---|
| | Fixable Minimum Temperature [° C.] | Fixable Maximum Temperature [° C.] | Total Quality |
| Example 4 | 145 | 205 | ○ |
| Example 5 | 145 | 200 | ○ |
| Example 6 | 145 | Not less than 210 | ○ |
| Example 7 | 150 | Not less than 210 | ○ |
| Comparative Example 1 | 145 | Not less than 210 | X |
| Comparative Example 2 | 155 | Not less than 210 | X |
| Comparative Example 3 | 145 | Not less than 210 | X |
| Comparative Example 4 | 145 | Not less than 210 | X |
| Comparative Example 5 | 145 | Not less than 210 | X |
| Comparative Example 6 | 150 | 165 | X |
| Comparative Example 7 | 155 | Not less than 210 | X |
| Comparative Example 8 | 155 | Not less than 210 | X |

As is apparent from Tables 3-1 to 3-3, the toner of the present invention has good fluidity and temporal charge stability, and produces high-quality images without abnormal images such as deterioration of image density and background fouling.

In contrast, the toners of Comparative Examples 1 to 8 has poor fluidity and temporal charge stability, and produces poor quality images with deterioration of image density and background fouling after 100,000 images are produced.

As evident from the above, the invention toner represents an important advance in the art. While this toner makes up a paret of the invention, also a part thereof is:

an image forming method comprising charging a photoreceptor; irradiating the photoreceptor to form an electrostatic latent image thereon; developing the electrostatic latent image with a toner according to the invention to form a toner image on the photoreceptor; transferring the toner image onto a transfer sheet; and fixing the toner image on the transfer sheet;

An image forming apparatus comprising a charger for charging a photoreceptor; an irradiator for irradiating the photoreceptor to form an electrostatic latent image thereon; an image developer for developing the electrostatic latent image with a toner according to the invention to form a toner image on the photoreceptor; a transferer for transferring the toner image onto a transfer sheet; and a fixer for fixing the toner image on the transfer sheet; and a hollow, cylindrical toner bottle for discharging toner stored therein when mounted to an electrophotographic image forming apparatus in a substantially horizontal position and then rotated about an axis of said toner bottle, said toner bottle comprising the toner of the invention.

This application claims priority and contains subject matter related to Japanese Patent Application No. 2006-004712 filed on Jan. 12, 2006, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising:

a binder resin, and a release agent, wherein the following relationships are satisfied:

$$2\ \mu m \leqq D4 \leqq 4\ \mu m \quad (d)$$

$$0.05\ \mu m \leqq Dw \leqq 0.3\ \mu m \quad (e)$$

$$Dw \leqq 0.075 \times D4 \quad (f)$$

wherein D4 is a weight-average particle diameter of the toner and Dw is an average dispersion diameter of the release agent, and wherein the following relationships (1) and (2) are satisfied:

$$F \leqq -40 \times Dw + 19 \quad (1)$$

$$F \leqq 20 \times Dw + 5 \quad (2)$$

wherein F is the pulverizability index of the toner.

2. The toner of claim 1, wherein the release agent has a viscosity Gw of from 3 to 10 $mm^2/s$ at 100° C., and wherein the following relationship (3) is satisfied:

$$(Gr/1{,}000) - 5 \leqq Gw \leqq (Gr/1{,}000) + 2 \quad (3)$$

wherein Gr is a viscosity (Pa·s) of the binder resin at 130° C.

3. The toner of claim 1, wherein the release agent comprises a wax having:

a molecular weight distribution comprising a main peak of from 1,000 to 2,500; and a ratio (Mw/Mn) of a weight-average molecular weight (Mw) thereof to a number-average molecular weight (Mn) thereof of from 1.3 to 1.8.

4. The toner of claim 1, wherein the release agent comprises carnauba wax.

5. The toner of claim 1, wherein the release agent is present in an amount of from 1 to 8 parts by weight per 100 parts by weight of the binder resin.

6. The toner of claim 1, wherein the toner is prepared by a method comprising:

kneading toner constituents comprising the binder resin, the release agent and a colorant to prepare kneaded toner constituents; and pulverizing the toner constituents.

7. The toner of claim 1, wherein the toner comprises particulate materials having a particle diameter not greater than 1.0 μm in an amount 10% or less in number.

8. The toner of claim 1, wherein the toner has a weight-average particle diameter (D4) of from 2.0 to 4.0 μm and a ratio (D4/Dn) thereof to a number-average particle diameter of from 1.00 to 1.40.

9. A developer comprising a carrier and the toner according to claim 1.

10. A two-component developer comprising a magnetic carrier and the toner according to claim 1.

11. An imaging forming method comprising: charging a photoreceptor; irradiating the photoreceptor to form an electrostatic latent image thereon; developing the electrostatic latent image with a toner according to claim 1 to form a toner image on the photoreceptor; transferring the toner image onto a transfer sheet; and fixing the toner image on the transfer sheet.

12. An image forming apparatus comprising: a charger for charging a photoreceptor; an irradiator for irradiating the photoreceptor to form an electrostatic latent image thereon; an image developer for developing the electrostatic latent image with a toner according to claim 1 to form a toner image on the photoreceptor; a transferer for transferring the toner image onto a transfer sheet; and a fixer for fixing the toner image on the transfer sheet.

13. A hollow, cylindrical toner bottle for discharging toner stored therein when mounted to an electrophotographic image forming apparatus in a substantially horizontal position and then rotated about an axis of said toner bottle, said toner bottle comprising the toner of claim 1.

* * * * *